United States Patent [19]

Kopal et al.

[11] 3,990,269

[45] Nov. 9, 1976

[54] KNITTING MACHINES AND IMPACTLESS NEEDLE THEREFOR

[75] Inventors: Jaroslav Kopal, Liberec; Milos Jansa, Brno; Jaroslav Deiss, Tisnov; Jiri Pobrislo, Kokonin, all of Czechoslovakia

[73] Assignee: Vyzkumny a vyvojovy ustav Zavodu vseobecho strojitrenstvi, Brno, Czechoslovakia

[22] Filed: Mar. 19, 1975

[21] Appl. No.: 559,967

Related U.S. Application Data

[63] Continuation-in-part of Ser. No. 225,155, Feb. 10, 1972, abandoned.

[52] U.S. Cl. ..... 66/123

[51] Int. Cl.[2] ..... D04B 35/02

[58] Field of Search ..... 66/123, 124, 50 A

[56] References Cited

UNITED STATES PATENTS

| | | | |
|---|---|---|---|
| 668,833 | 2/1901 | Gilbert | 66/124 |
| 1,198,280 | 9/1916 | Rush | 66/123 X |
| 2,030,261 | 2/1936 | Lombardi | 66/123 X |
| 2,076,896 | 4/1937 | Jones | 66/123 |
| 3,513,666 | 5/1970 | Mishcon | 66/50 A |

FOREIGN PATENTS OR APPLICATIONS

| | | | |
|---|---|---|---|
| 611,413 | 3/1935 | Germany | 66/124 |

*Primary Examiner*—Mervin Stein
*Assistant Examiner*—Andrew M. Falik

[57] ABSTRACT

Knitting needle especially for circular knitting machines, having a shock-absorbing shank. The knitting needle is torsionally twisted through a certain angle in the region of its butt. The torsional twist, on the one hand, takes up the clearance in the needle trick of the needle carrier, and on the other hand, permits springing of the needle in the region of the butt, by its impact on the raising or sinker cam of a cam box system, which leads to damping the impact force. This springing of the needle also diminishes the angle of the twist, thus enabling the effecting of a line contact of a corresponding part of the butt with the cam edge. The friction between twisted needle stem or shank and its trick prevents the throwing off of the needle, thus reducing the stress to which the needles and the cam edges are exposed. The reduction of the impact force also reduces still other forces which affect the needle in the needle trick.

The invention also relates to a circular knitting machine incorporating the above-described impactless needles.

2 Claims, 5 Drawing Figures

KNITTING MACHINES AND IMPACTLESS NEEDLE THEREFOR

This application is a continuation-in-part of application Ser. No. 225,155, filed Feb. 10, 1972 now abandoned.

This invention relates to an impactless needle especially for circular knitting machines, such needle permitting the decrease of the impact of a needle butt of flat and circular one-direction knitting machines against the skewed acting edge of raising cams and sinker cams.

The invention also relates to a circular knitting machine incorporating the impactless knitting needles of the invention.

Known devices are so constructed and arranged that when a needle butt passes through a camming mechanism, there occur substantial impacts between the needle butt and the acting edge of the cam. It is mainly the first blow with which the needle butt contacts the cam which causes great stressing of the needles and parts of the cam paths, such parts being quickly worn off, thereby resulting in the quick consequent breaking off of the needle butts. The first impact, which is very severe, can also result in the breaking of the needle hooks as a consequence of longitudinal vibrations generated in the needle body by such impact.

The principal object of the present invention is to obviate the described disadvantages of the known arrangements, and to produce an impactless needle. The present invention is, in substance, based on the fact that a short portion of the lower part of a needle with a butt is helically twisted around the longitudinal axis of the needle towards the upper part of a needle, wherein the direction of this helical twisting or turning of the lower part of a needle is opposite the direction of the force which the cam or cams exert on the needle butt.

The arrangement according to the present invention substantially reduces the first impact between the butt and the cam, thus decreasing the wear of the cams and needles; as a consequence, the speed of operation of the machines may be increased. Another advantage of the present invention is comparatively simple technology of manufacturing the parts and the minimum productional costs involved.

To enable the nature of the invention to be more easily understood, one embodiment of the invention will now be described by way of example with reference to the accompanying drawings. In the drawings.

Figure 1:
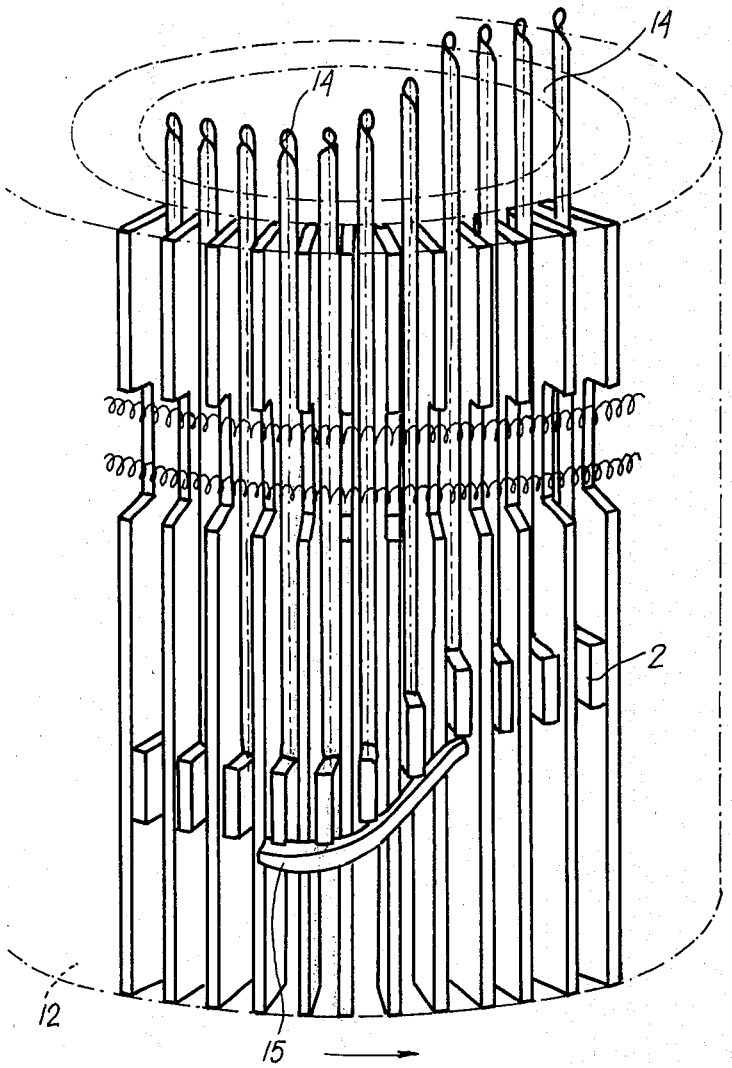
FIG. 1 is a fragmentary view in perspective of the rotatable needle carrier or cylinder of a circular knitting machine carrying needles in accordance with the present invention, the butts of certain of the needles being shown cooperating with a stationary cam.

In FIG. 1 the cylinder or needle carrier 12 of a circular knitting machine carrying a plurality of knitting needles 14 in parallel tricks rotates in the direction of the curved arrow, butts 2 on the stems 1 of the needles coacting with a cam 15 which acts to raise the needles as shown. The illustrative embodiment of impactless needle according to the present invention, in order to decrease the strength of or cushion the first impact between butts 2 and cam 15, has its stem 1 helically twisted about the longitudinal axis of the stem. As a result, when the butt 2 of the needle is in contact with the cam 15, the relatively short helically twisted zone of said stem 1 acts as a torsion bar; the elasticity of such torsion bar substantially decreases the severity of the first impact. This alteration of the needle stem 1 consists basically in the fact that the stem 1 is helically twisted around the longitudinal needle axis so that the lower part of the needle, the needle butt 2 included, is turned with respect to the upper part of said needle. The direction of the helical twisting of the lower needle part is opposite to the direction P (FIG. 2) of the force which the cam 15 exerts on the needle butt 2. When such twisted needle is put into a trick or groove 5 in a machine bed or needle carrier 12, there is a clearance S between the needle butt 2 and the leading wall 4 of the bed trick 5 of the knitting machine. Such clearance S is shown exaggerated in FIG. 2 for clarity of illustration. Such clearance is located on the opposite side of the needle butt 2 from that upon which the stressing force P exerted by the cam 15 acts upon the needle. When the needle impinges upon said cam, the clearance S is filled with the needle stem 1, that is, the part of the needle bearing butt 2 is twisted counter-clockwise (FIG. 3) so that the left-hand surface of the needle lies coplanar of the left-hand sidewall of the groove. As a result, stressing of the upper part of the needle is reduced. This arrangement according to the present invention can be used with punched needles as well as with drawn ones.

Figure 2:
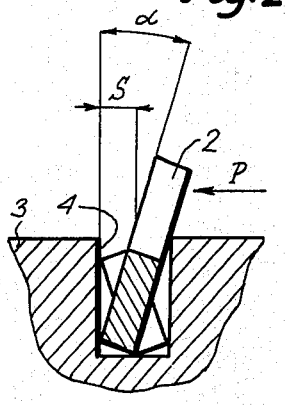
FIG. 2 is a sectional view of an impactless needle according to the present invention placed within a groove of a machine bed, the section being taken in the vicinity of a needle butt.
Figure 3:
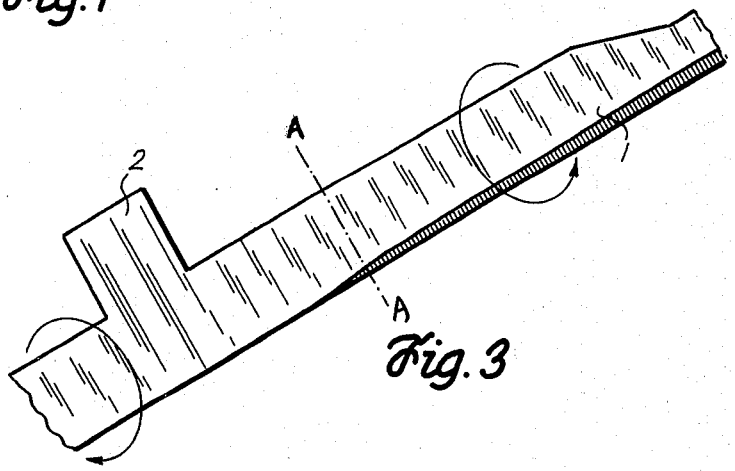
FIG. 3 is an axonometric view of a lower part of an impactless needle with a butt.
Figure 5:
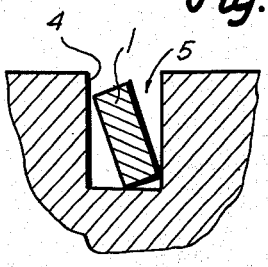
FIG. 5 is a view in section through such structure, the section being taken along the plane of line B—B of FIG. 4.

In the practical embodiment of the needle of the present invention shown in FIGS. 2 and 3, the twisting of the lower part of the needle stem 1 carrying the butt 2 is carried out below the transverse axis A—A (FIG. 3) in the direction of the curved arrowhead (that is, clockwise in FIG. 3) with respect to the upper part of the needle stem 1. When the needle is put into the groove 5 of the machine bed 3, there is formed between the needle butt 2 and the wall 4 of the machine bed groove 5 the clearance S. The needle stem 1 is there inclined from the wall 4 of the groove 5 by an angle "$\alpha$". When the force P is applied to the butt by the cam 15, the needle stem 1 is again straightened and the clearance S is filled or removed. During this action, the short helically twisted portion of the needle stem 1 acts as a torsion bar; this reduces the impact of the needle butt 2 upon the cam.

Figure 4:
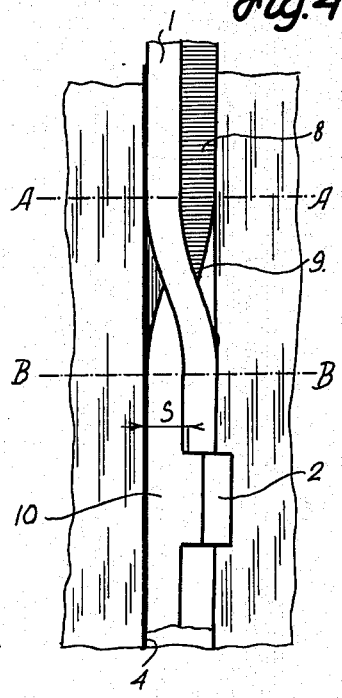
FIG. 4 is a fragmentary view in elevation of the structure shown in FIG. 2, the view being taken from the top and looking downwardly in FIG. 2.

The manner of twisting of the needle shank will be more readily apparent in FIG. 4. As there is shown, the upper portion of the needle shank, designated 8, above the line A—A is straight and untwisted. The lower part of the needle shank, which encloses a butt 2, below the line B—B, and designated generally by the reference character 10, is also straight and untwisted. The transverse axis of the shank portions 8 and 10, however, lie at a substantial angle with respect to each other by reason of the twist which has been inserted into the relatively short intermediate portion 9 of the needle shank, between the lines A—A and B—B.

In a commercial embodiment of a device in accordance with the invention, the value of the clearance S is 0.05–0.1 mm. As will be evident in the drawings, and from the above description, the width of the groove 5 in which the needle is mounted is constant along its total length. As is perhaps most readily apparent in FIGS. 3 and 4, by the imposition of the force to the left in FIG. 3 on butt 2, only the lower portion of the needle as there shown is twisted within the range of the clearance S. The upper part of the needle as there shown, above the section line A—A in FIG. 3, does not change its position, since it is locked in the groove 5 against turning counterclockwise as it is shown in FIG. 4 by engagement between the left and right-hand walls of the groove in the upper left and lower right corners, respectively, of the stem 1 of the needle as shown in FIG. 4.

The needle and the knitting machine of the present invention display marked advantages over the knitting machine and the needle shown in FIG. 11*a* of Gilbert, U.S. Pat. No. 668,833, wherein the needle has a uniform twist from end to end about its longitudinal axis:

1. The needle of the invention ensures much better absorption of the shock, when the butts are engaged by the cams.

2. It is more effective, as far as the said absorption is concerned.

3. The shock-absorbing effect works definitely during the whole operation.

4. The needle shank is made from one piece of sheet metal and that is why it is more solid and more resilient than that according to Gilbert, which is thickened in the part containing the butt.

5. The needle shank of the present invention is twisted in only a small zone, while according to Gilbert it is twisted uniformly throughout its length. Thus with the needle of Gilbert, the twisting force-deformation curve rises at a shallow angle, whereas with the needle of the present invention, such curve rises steeply, on the order, for example, of 45%.

Although the invention is illustrated and described with reference to a single preferred embodiment thereof, it is to be expressly understood that it is to be in no way limited to the disclosure of such a preferred embodiment, but is capable of numerous modifications within the scope of the appended claims.

What is claimed is:

1. In a knitting needle adapted for longitudinal movement in an elongated needle trick of a circular knitting machine, the needle having an elongated stem made up of a straight untwisted upper part, a straight untwisted lower part, and an intermediate part twisted in one direction around the axis of the stem, whereby the lower part of said stem is twisted around its longitudinal axis with respect to its upper part, and a butt on the lower part of the needle, the improvement wherein the twisted intermediate part of the needle is short relative to the upper and lower parts and exhibits a significant angle of twist, and wherein the upper part of the needle is dimensioned to preclude substantial rotation of the needle within the trick when a force is applied to the needle butt in a direction opposite to the direction of twist of the intermediate part.

2. In a knitting machine having a knitting machine bed rotatable in a first forward direction, the bed exhibiting a plurality of elongated knitting tricks, and a plurality of knitting needles cooperable with and movable longitudinally in the tricks, each needle having an elongated stem made up of a straight untwisted upper part, a straight untwisted lower part, and an intermediate part twisted in one direction around the axis of the stem, the lower part of the needle exhibiting a butt extending outwardly from the associated trick, and at least one stationary lock disposed in the path of rotation of the needle bed and adapted to engage the butts of successive ones of the needles as the bed is rotated to thereby move the needles longitudinally in the associated tricks, the improvement wherein the intermediate part of the needle is short relative to the upper and lower parts and exhibits a substantial angle of twist in a direction corresponding to the direction of advance of the needle bed, whereby the engagement of the stationary lock by the butt of each of the twisted needles subjects the butt to a force in a direction opposite to the direction of twist of the intermediate part; and wherein the upper part of the needle is dimensioned to preclude substantial rotation of the needle within the trick in response to said force.

* * * * *